US009431192B2

(12) United States Patent
Kamor

(10) Patent No.: US 9,431,192 B2
(45) Date of Patent: Aug. 30, 2016

(54) ACTUATOR BIASED BY A HORIZONTAL MEMBER

(71) Applicant: Leviton Manufacturing Co., Inc., Melville, NY (US)

(72) Inventor: Michael Kamor, North Massapequa, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 173 days.

(21) Appl. No.: 14/227,769

(22) Filed: Mar. 27, 2014

(65) Prior Publication Data

US 2015/0279593 A1 Oct. 1, 2015

(51) Int. Cl.

| | |
|---|---|
| ***H01H 3/08*** | (2006.01) |
| ***H01H 19/00*** | (2006.01) |
| ***H01H 19/14*** | (2006.01) |
| ***H01H 21/00*** | (2006.01) |
| ***H01H 23/14*** | (2006.01) |
| ***H01H 3/50*** | (2006.01) |
| *H01H 23/20* | (2006.01) |

(52) U.S. Cl.
CPC ..... *H01H 23/145* (2013.01); *H01H 3/50* (2013.01); *H01H 23/20* (2013.01)

(58) Field of Classification Search
CPC ..... H01H 3/00; H01H 3/02; H01H 3/08; H01H 19/00; H01H 19/14; H01H 21/00; H01H 21/04; H01H 21/36; H01H 23/00; H01H 23/16; H01H 23/24; H01H 2221/016; H01H 2233/03; H01H 2300/01; H01H 3/04; H01H 2003/00; H01H 2003/02; H01H 2021/00; H01H 2221/00; H01H 2221/018; H01H 23/20; H01H 21/24; H01H 21/02; H01H 19/635; H02G 3/14
USPC ..... 200/336, 297, 293, 5 E, 56 R, 61.02, 200/308, 310, 312–314, 317, 302.1, 333
See application file for complete search history.

(56) References Cited

U.S. PATENT DOCUMENTS

| | | | | |
|---|---|---|---|---|
| 5,207,317 | A | 5/1993 | Bryde et al. | |
| 5,950,812 | A | 9/1999 | Tanacan et al. | |
| 6,005,308 | A * | 12/1999 | Bryde | H05B 39/00 200/335 |
| 6,875,940 | B2 | 4/2005 | Endres et al. | |
| 7,170,018 | B2 | 1/2007 | Ilkhanov | |
| 7,416,310 | B1 * | 8/2008 | Savicki, Jr. | H01H 3/0213 200/317 |
| 8,003,904 | B2 | 8/2011 | Wu | |
| 2011/0259722 | A1 | 10/2011 | Alderson et al. | |

* cited by examiner

*Primary Examiner* — Edwin A. Leon
*Assistant Examiner* — Anthony R. Jimenez
(74) *Attorney, Agent, or Firm* — Leviton Manufacturing Co., Inc.

(57) ABSTRACT

An exemplary embodiment of an electrical device is disclosed. The electrical wiring device preferably includes a frame, a rocker, and a resilient member. In use, the rocker pivotally rotates through a range of travel, for example, from a first position to a second position. As the rocker moves, the resilient member imparts a force on the rocker, biasing the rocker in the first position and the second position. In a particularly preferred embodiment, the resilient member extends horizontally across the electrical wiring device (e.g., along a minor axis of the rocker).

27 Claims, 15 Drawing Sheets

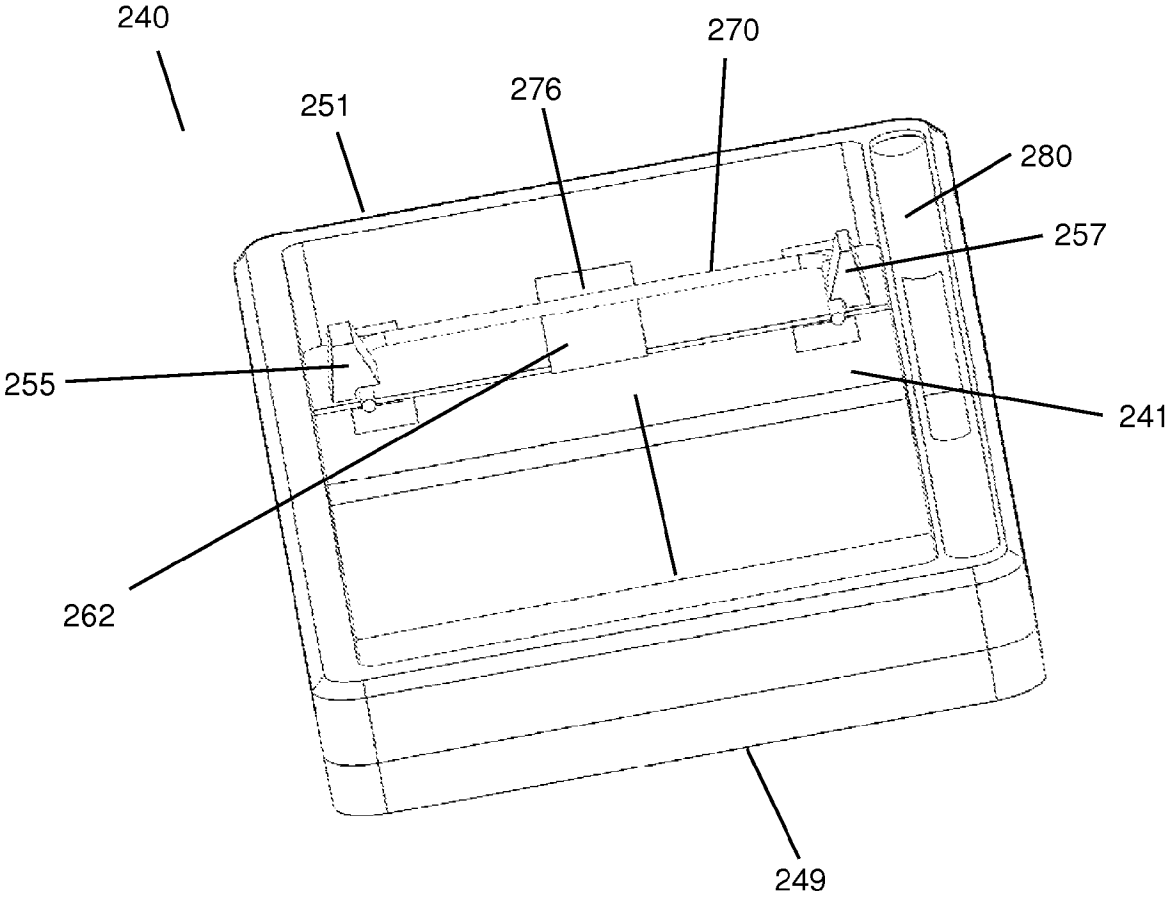
FIB. 8B

ACTUATOR BIASED BY A HORIZONTAL MEMBER

FIELD OF THE DISCLOSURE

The present disclosure relates generally to an electrical wiring device and, more particularly, relates to a switch actuator assembly for activating a switch in an electrical wiring device.

DESCRIPTION OF THE RELATED ART

Electrical wiring devices, such as switches, dimmer switches, etc., typically include a spring mechanism to actuate the switching component. When a user pushes an actuator on a wiring device, the spring mechanism is typically configured so that the spring mechanism is displaced along its longitudinal axis. However, this type of design has disadvantages because there is limited space in a wiring device, and a spring mechanism configured to be displaced along its longitudinal axis takes up valuable space and requires substantial depth in the wiring device to accommodate the movement of the spring mechanism. In addition, a design with the spring mechanism displaced along its longitudinal axis typically requires other components to be included in the wiring device, such as a lever mechanism, which takes up additional space and increases manufacturing costs. These types of designs are particularly disadvantageous in interchangeable color change kits that typically include the mechanism components in the rocker-frame assembly, which is separate from the rest of the electrical device.

It would be desirable for a wiring device to have an actuator biased by a component that is not displaced along its longitudinal axis. This would allow for the overall depth of the wiring device to decrease without compromising the balanced "feel" by the user when pressing the actuator. In addition, the number of unique parts required for manufacturing wiring devices would decrease, which would also reduce manufacturing complexity and costs, including inventory costs, labor costs, molding costs, etc.

SUMMARY OF THE DISCLOSURE

A switch actuator assembly for activating a switch in an electrical wiring device is disclosed. The switch actuator assembly preferably includes a frame having a peripheral wall, a rocker, first and second resilient member supports, a tab having a contact surface, and a resilient member. The first and second resilient member supports may extend from opposite sides of either the frame or the rocker, and the tab may extend from the other of the frame or the rocker. The first and second resilient member supports are preferably arranged and configured to be in registered alignment with respect to one another to form an axis. The resilient member preferably includes a first end, a second end, and a middle portion. A longitudinal axis of the resilient member may be defined between the first and second ends. The first and second ends are preferably configured to engage the first and second resilient member supports respectively, and the middle portion is preferably configured to interact with the tab. In use, the rocker is preferably pivotally mounted to the frame and configured to rotate between a first position and a second position. The contact surface of the tab preferably deflects the resilient member in a direction that is perpendicular to the longitudinal axis of the resilient member when the rocker is in the first position and the second position.

In a second, alternate embodiment of a switch actuator assembly for activating a switch in an electrical wiring device, the switch actuator assembly preferably includes a frame, a rocker, and a resilient member. The frame preferably includes first and second frame mounting members, a bottom wall, and first and second trunnions. The first and second frame mounting members preferably extend from the bottom wall, and the first and second trunnions are parallel to the bottom wall and project inwardly. The rocker preferably includes a bottom surface, a tab, and first and second sides. The tab preferably includes first and second surfaces, and the tab preferably extends from the bottom surface of the rocker. The first and second sides of the rocker preferably include first and second rocker mounting members respectively. The first and second rocker mounting members are preferably arranged and configured to pivotally mount to the first and second frame mounting members respectively. The resilient member preferably includes first and second ends and a bearing surface. A longitudinal axis of the resilient member may be defined between the first and second ends. The first and second ends are preferably configured to engage the first and second trunnions respectively, and the bearing surface is preferably arranged and configured to interact with the tab of the rocker. In use, the rocker is preferably adapted and configured to pivotally rotate between a first position and a second position. The first surface of the tab preferably deflects the bearing surface of the resilient member when the rocker is in the first position, and the second surface of the tab preferably deflects the bearing surface of the resilient member when the rocker is in the second position.

BRIEF DESCRIPTION OF THE SEVERAL VIEWS OF THE DRAWING(S)

One or more aspects of the present invention are particularly pointed out and distinctly claimed as examples in the claims at the conclusion of the specification. The foregoing and other objects, features, and advantages of the present invention may be more readily understood by one skilled in the art with reference being had to the following detailed description of several embodiments thereof, taken in conjunction with the accompanying drawings wherein like elements are designated by identical reference numerals throughout the several views, and in which:

FIG. 8B is a perspective view of the frame and the wire of the rocker-frame assembly of FIG. 8A.

DETAILED DESCRIPTION

The present disclosure describes an apparatus, assembly and method for an electrical wiring device having an actuator (e.g., a rocker) biased by a resilient member. Embodiments will be described below while referencing the accompanying figures. The accompanying figures are merely examples and are not intended to limit the scope of the present disclosure.

Figure 1:
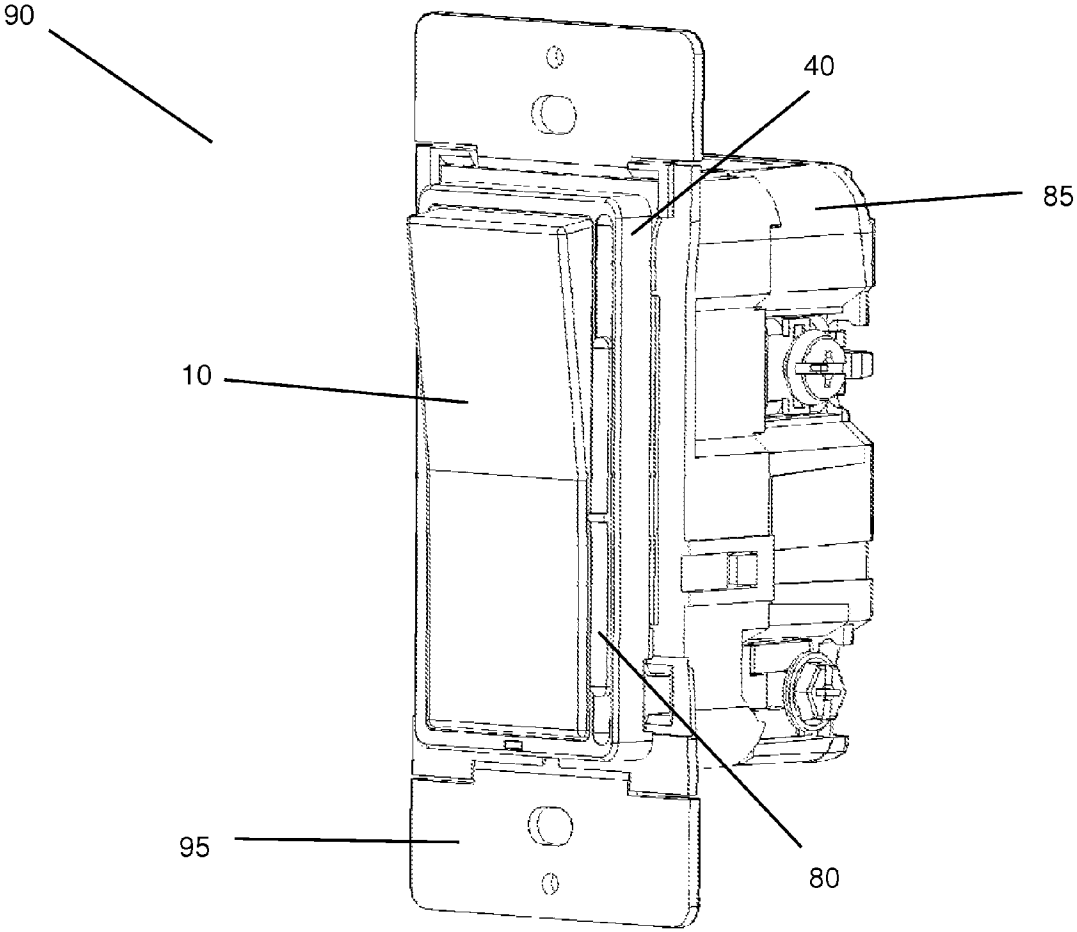
FIG. 1 is a perspective view of an exemplary embodiment of an electrical wiring device.
Figure 7:
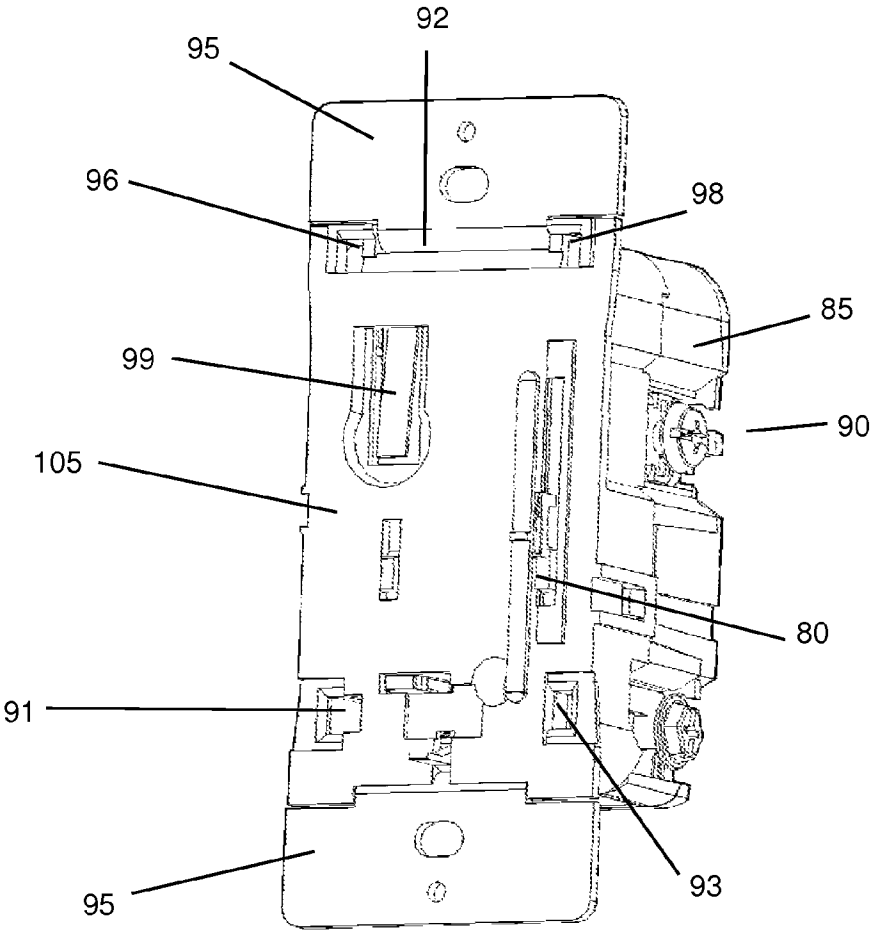
FIG. 7 is a perspective view of the electrical device of FIG. 1, with the rocker-frame assembly removed.

FIG. 1 illustrates an exemplary embodiment of an electrical wiring device 90. As shown, the electrical wiring device 90 may include a rocker 10, a base 85, a frame 40, and a yoke 95. In addition, the electrical wiring device 90 may include a switch 99 and a front housing 105 (see FIG. 7). The switch 99 is adapted and configured for turning power "on"/"off" to an electrical load. In some embodiments, the electrical wiring device 90 may also include an optional slide potentiometer or slide switch 80 for dimmer and motor load control applications. In use, the rocker 10 is movable through a range of travel, for example, from a first position (see FIG. 2D) and a second position (see FIG. 2E). The first position of the rocker 10 corresponds to the "off" position of the electrical wiring device 90; while the second position of the rocker 10 corresponds to the "on" position of the electrical wiring device 90. As will be described in more detail below, when the rocker 10 is in the second position, the rocker 10 is pressing down on the switch 99, thereby actuating the switch 99 and turning the power "on"; and, when the rocker 10 is in the first position, the rocker is not pressing down on or actuating the switch, and thus the power is "off." However, it will be understood by one of ordinary skill in the art that in other embodiments, such as embodiments that include a three-way switch, the "on" and "off" status with respect to the rocker position may change.

Figure 2A:
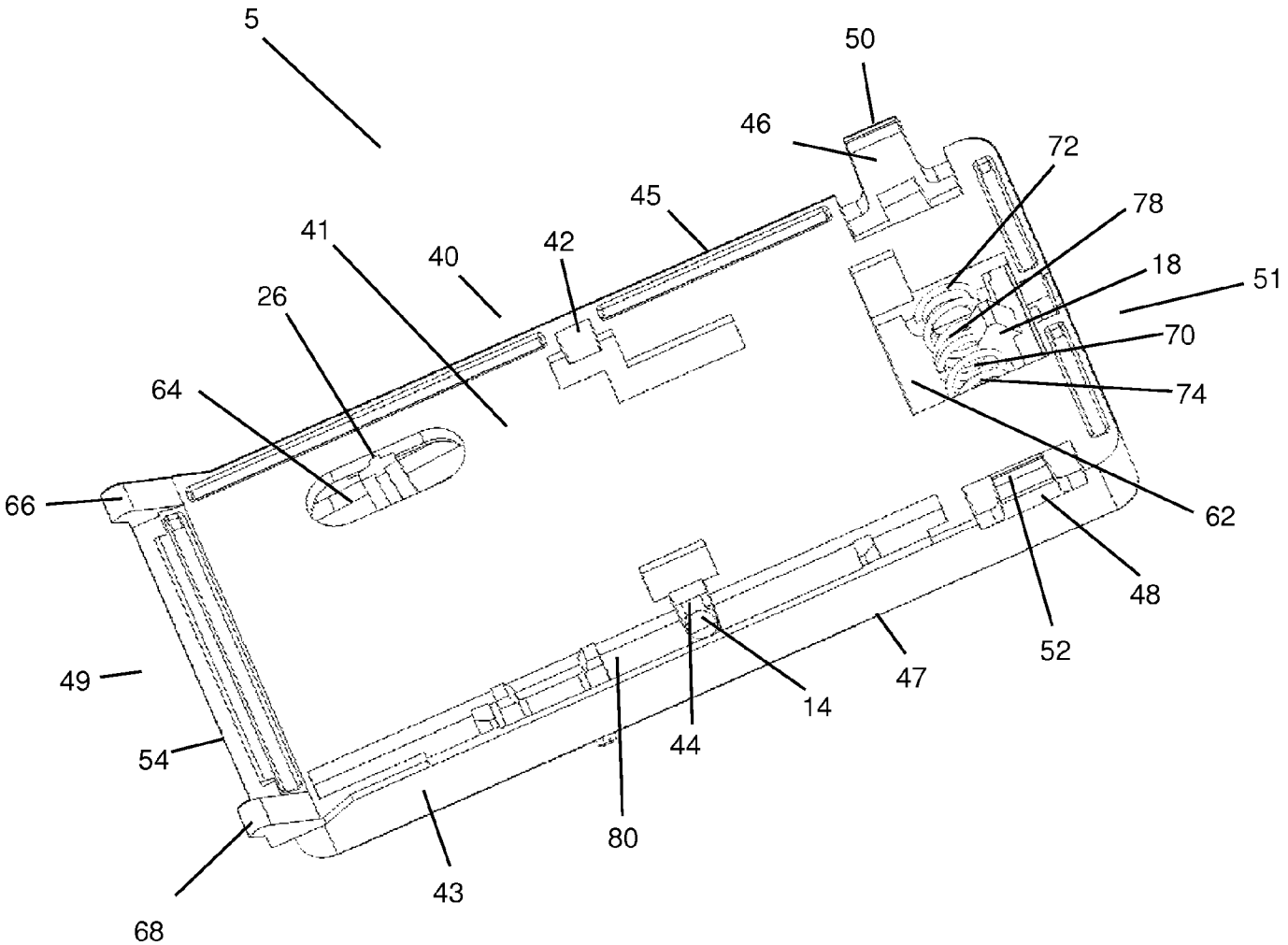
FIG. 2A is a perspective view of an exemplary embodiment of a rocker-frame assembly and a slide switch.
Figure 2B:
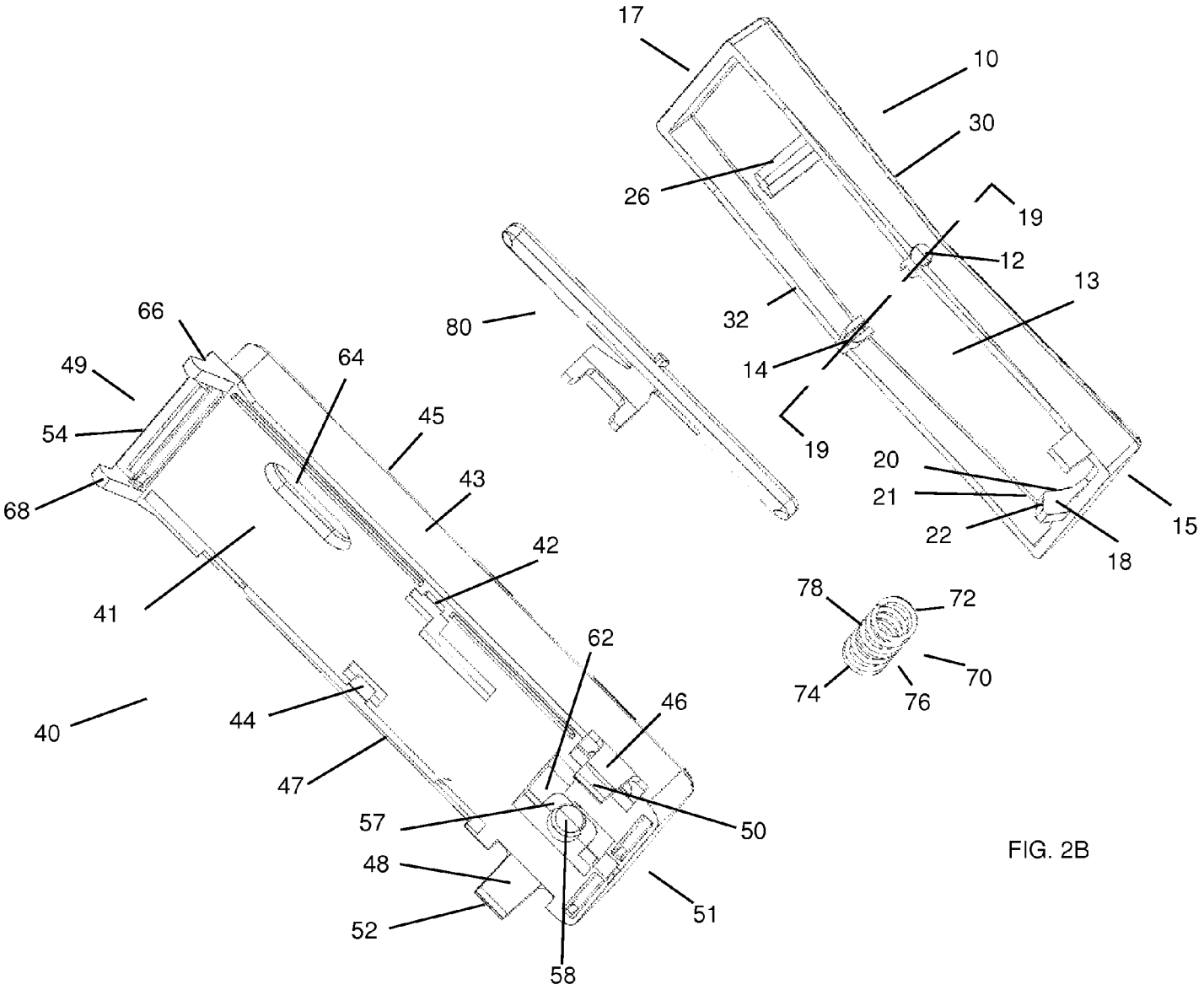
FIG. 2B is an exploded view of the rocker-frame assembly and the slide switch of FIG. 2A.
Figure 2C:
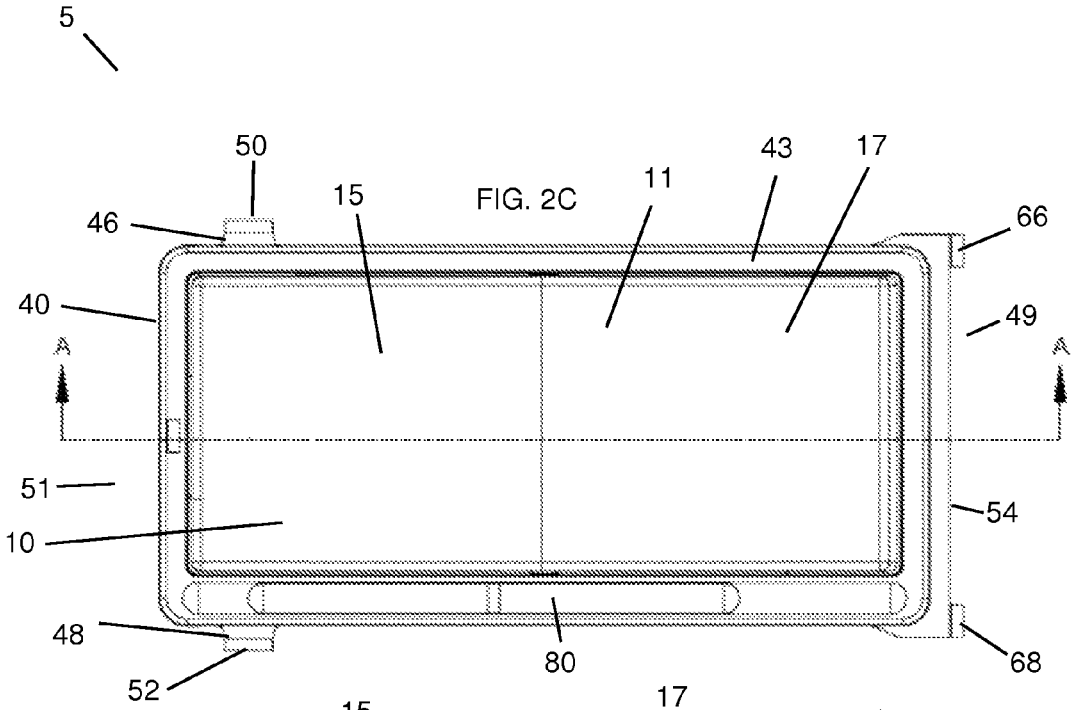
FIG. 2C is a front view of the rocker-frame assembly and the slide switch of FIG. 2A.
Figure 8A:
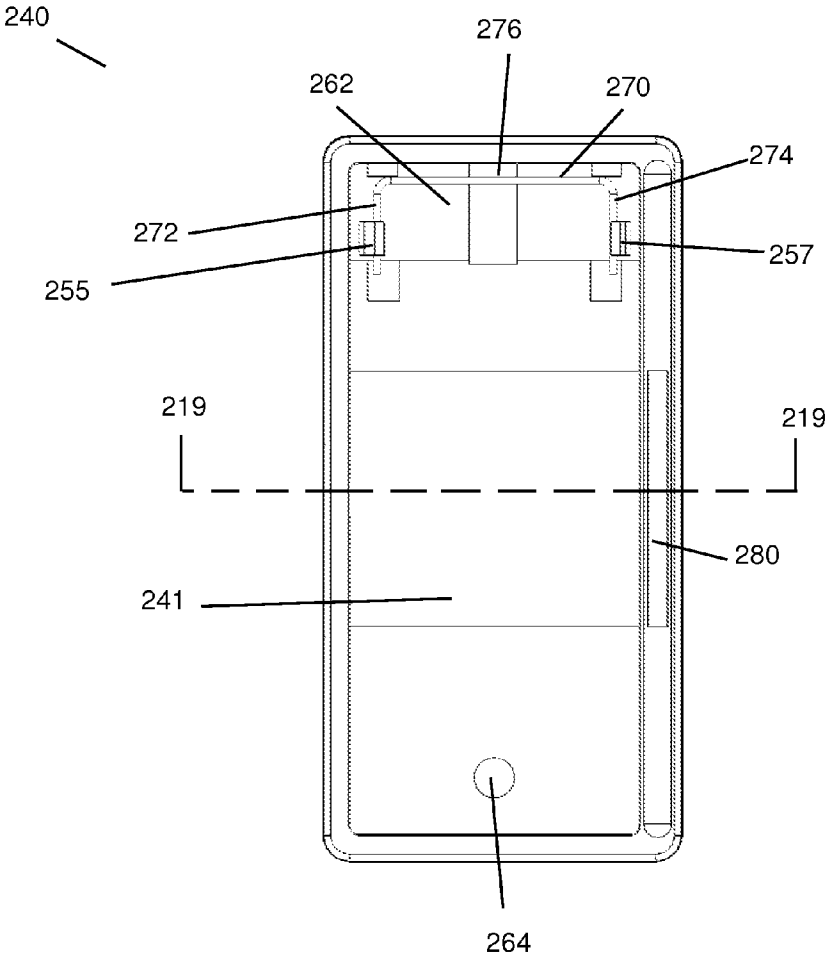
FIG. 8A is a top view of an exemplary embodiment of a frame and a wire of the rocker-frame assembly.

According to one aspect of the present invention, the electrical wiring device 90 preferably includes a resilient member to impart a force on the rocker 10, biasing the rocker 10 through a range of travel, for example, from the first position and the second position. More preferably, the resilient member extends horizontally across the electrical wiring device 90 (e.g., along a minor axis of the rocker 10). The resilient member may be any resilient member or material that can apply a biasing force now or hereafter known in the art including a spring, a wire (as shown in FIG. 8A), a rubber piece, a plastic piece, and the like. Preferably, as best shown in FIG. 2A, the resilient member is a coil spring.

As will be described in greater detail below, the rocker 10, the frame 40, the resilient member, and the optional slide potentiometer or slide switch 80 for dimmer and motor load control applications may be incorporated into a rocker-frame assembly 5 so that the rocker-frame assembly 5 is removable from the base 85. In this manner, the rocker-frame assembly 5 may be provided as an interchangeable color changing kit that enables an installer or end user to easily change the color of the visible portions of the device 90 to coordinate with changes in the building décor or occupant preferences. Alternatively, as will be appreciated by one of ordinary skill in the art, the rocker 10 may be permanently coupled to the base 85.

Referring to FIGS. 2A-2F, an exemplary embodiment of the rocker-frame assembly 5 will now be described. As previously mentioned, the rocker-frame assembly 5 may include a rocker 10, a frame 40, and a resilient member, such as the spring 70. In some embodiments, the rocker-frame assembly 5 may also include an optional slide potentiometer or slide switch 80 for dimmer and motor load control applications. As will be described in further detail below, the rocker-frame assembly 5 uses the buckling resistance of the spring 70 to impart a force on the rocker 10, biasing the rocker 10 in a first position and a second position. The first position of the rocker-frame assembly 5 corresponds to the "off" position of the switch 99; and, the second position of the rocker-frame assembly 5 corresponds to the "on" position of the switch 99.

As shown in FIGS. 2A-2F and 3A-3C, the rocker 10 may include a first end 15, a second end 17, a top surface 11, and a bottom surface 13. The rocker 10 may also include a tab 18 and an arm 26. The tab 18 and the arm 26 may extend from the bottom surface 13 of the rocker 10. More specifically, the tab 18 may extend from the bottom surface 13 of the first end 15 of the rocker 10, and the arm 26 may extend from the bottom surface 13 of the second end 17 of the rocker 10. However, in other embodiments, the tab may extend from the bottom surface of the second end of the rocker, and the arm may extend from the bottom surface of the first end of the rocker.

The tab 18 may include a contact surface 21 having a first surface 20 and a second surface 22. As will be described in greater detail below, the first and second surfaces 20, 22 are preferably angled relative to a planar surface E-E, which is substantially parallel to a longitudinal axis Y' of the resilient member or spring 70 (see FIGS. 3C and 5-6B). In one exemplary embodiment, the angle of the first surface 20 is preferably 62 degrees, and the angle of the second surface 22 is preferably 46 degrees. However, it will be understood by one of ordinary skill in the art that these quantified angles are merely examples, and the first surface 20 and/or the second surface 22 may be of a different angle with respect to the planar surface E-E.

In addition, the rocker 10 may include first and second pins 12, 14. The first and second pins 12, 14 may project from opposite sides 30, 32 of the rocker 10, and define a pivot axis 19. The top surface 11 of the rocker 10 is configured to be pressed by a user to change the position of the rocker 10. As shown, the top surface 11 is positioned at an inward angle towards the pivot axis. However, in other embodiments, any other suitable shape, contour, dimensions, angles, surfaces, etc. may be used for functional and/or aesthetic reasons.

As shown in FIGS. 2A-F and 4A-B, the frame 40 may include a bottom wall 41 and a peripheral wall 43 extending around the frame 40. The frame 40 may also include first and second slots 42, 44 positioned on opposite sides 45, 47 of the frame 40, and adapted and configured to receive the first and second pins 12, 14 of the rocker 10.

The frame 40 may also include first and second openings 62, 64 that are formed in the bottom wall 41. As will be described in more detail below, the first opening 62 is adapted and configured to be in registered alignment with and accommodate the tab 18 of the rocker 10 to allow the tab 18 to extend at least partially through the first opening 62 when the rocker 10 is in the first position; and, the second opening 64 is adapted and configured to be in registered alignment with and accommodate the arm 26 of the rocker 10 and the switch 99 of the electrical device 90 (see FIG. 7).

Figure 4A:
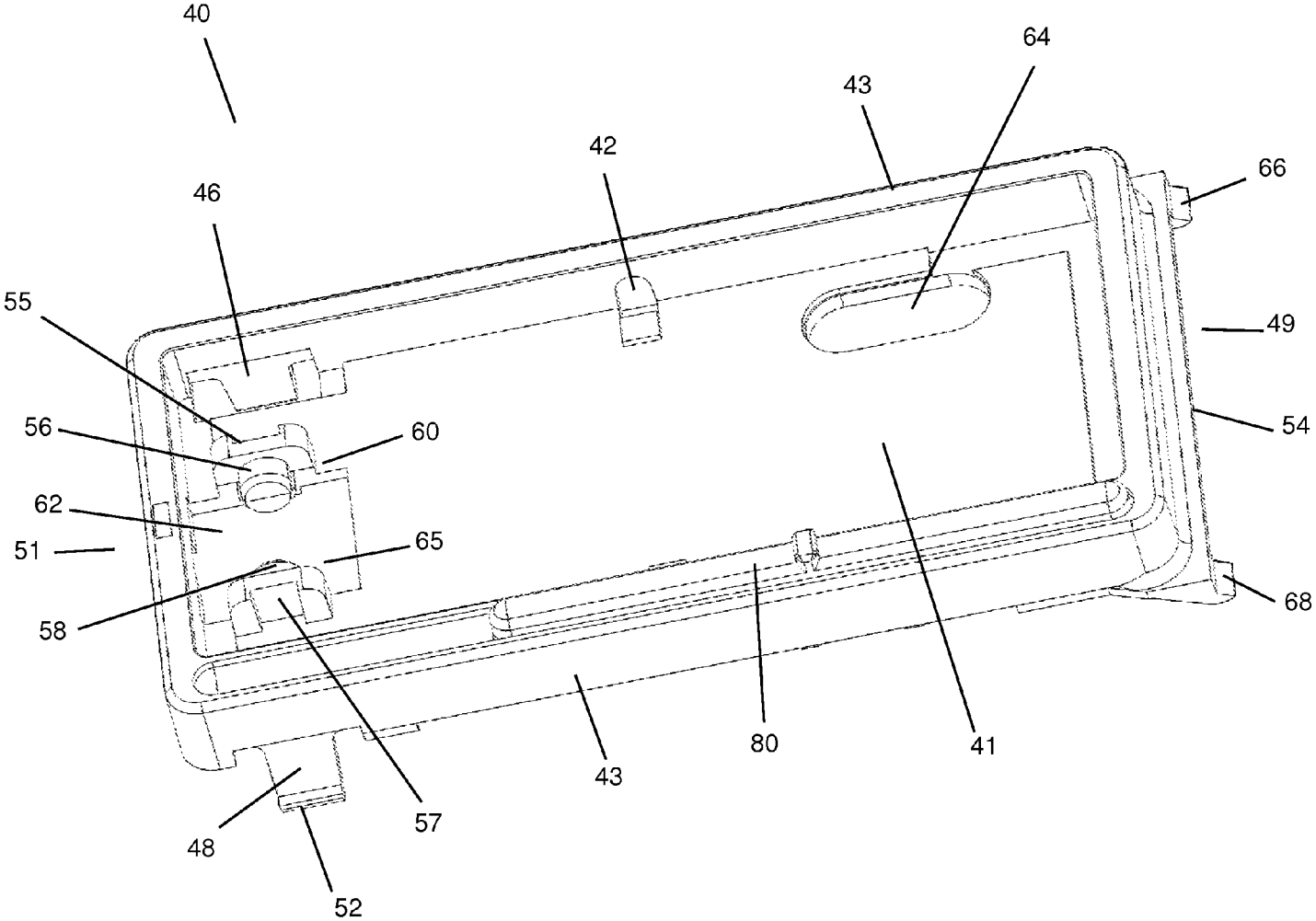
FIG. 4A is perspective view of a frame of the rocker-frame assembly and the slide switch of FIG. 2A.
Figure 4B:
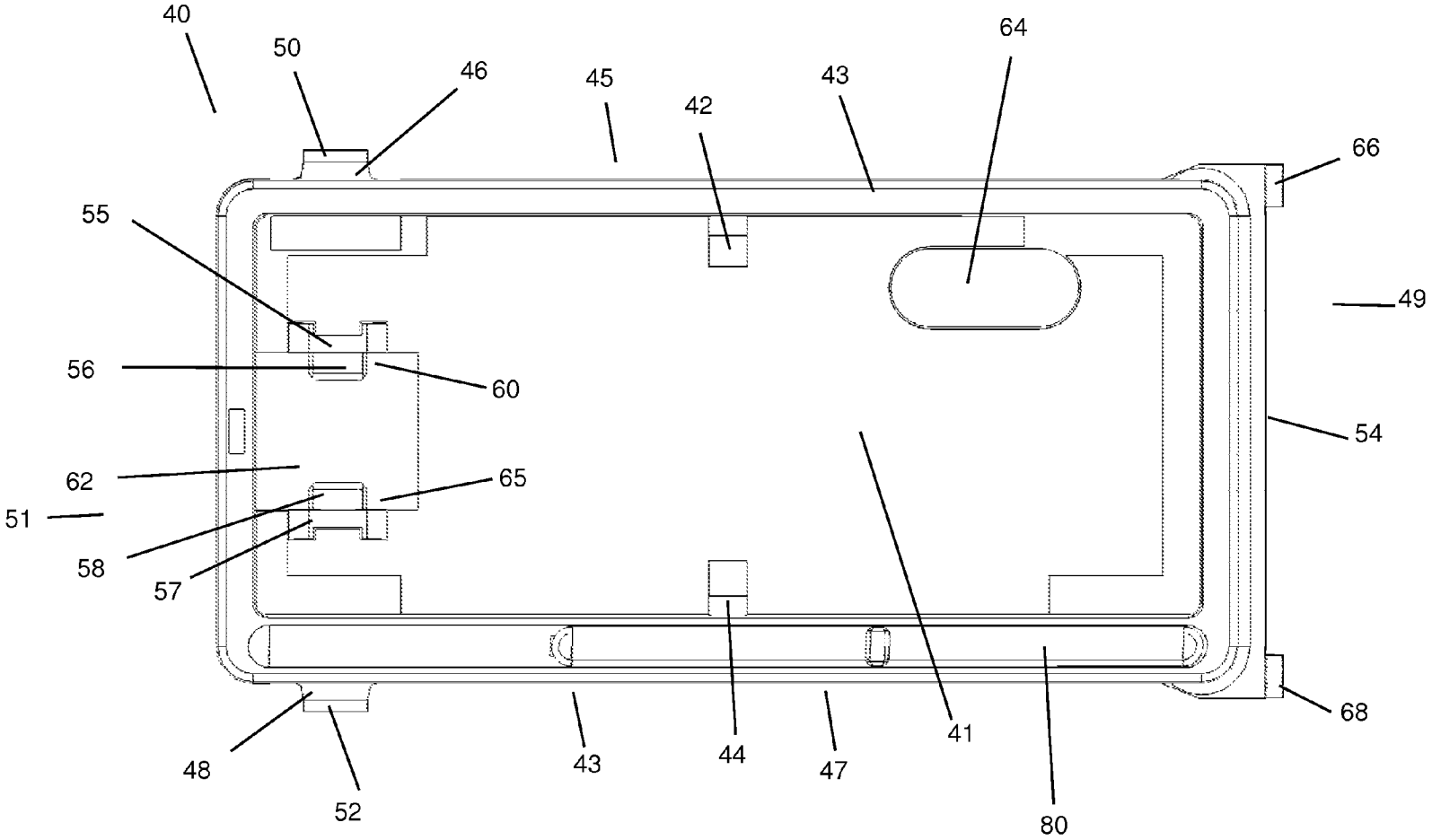
FIG. 4B is a top view of the frame and the slide switch of FIG. 4A.

The frame 40 preferably includes first and second resilient member supports 60, 65. The first and second resilient member supports 60, 65 may be arranged and configured to be in registered alignment with respect to one another to form an axis. In the embodiment of FIG. 4A-B, the first and second resilient member supports 60, 65 may include first and second support members 55, 57 and first and second trunnions 56, 58, respectively. The support members 55, 57 may extend from the bottom wall 41, and the first and second trunnions 56, 58 may extend from oppositely-facing inner surfaces of the first and second support members 55, 57, respectively. In use, the resilient member supports 60, 65 are positioned on opposite sides of the first opening 62 of the frame 40, and may be fixed. As will be described in more detail below, the first and second resilient member supports 60, 65 are each adapted and configured to receive an end 72, 74 of the spring 70 (see FIG. 6A-B). It will be understood by one of ordinary skill in the art that the resilient member supports may be any feature or component that is configured to support the resilient member. For example, in other embodiments, the resilient member supports may extend from the peripheral wall or sides of the frame. In other alternate embodiments, the resilient member supports may extend from the rocker.

The frame 40 may also include a hinge 54 extending from the bottom wall 41 thereof and positioned at one end 49 of the frame 40. The hinge 54 may include first and second feet 66, 68 that are positioned on opposite sides 45, 47 of the frame 40, respectively. Furthermore, the frame 40 may include first and second snaps 46, 48 extending from the bottom wall 41 and/or the peripheral wall 43, on opposite sides 45, 47 of the frame 40, respectively. The first and second snaps 46, 48 may each include a latch portion 50, 52, respectively. As will be described in more detail below, the hinge 54, feet 66, 68 and snaps 46, 48 are adapted and configured to engage with the front housing 105 of the electrical wiring device 90 to secure the rocker-frame assembly 5 to the electrical wiring device 90 (see FIGS. 1 and 7).

Figure 5:
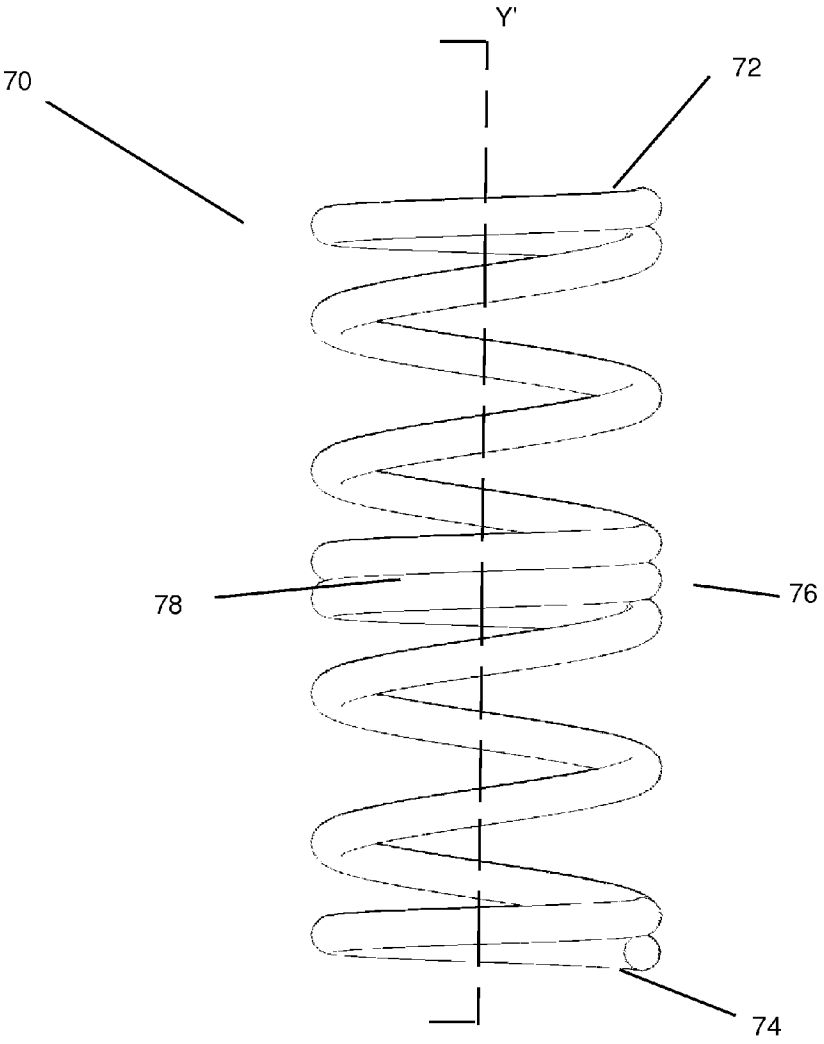
FIG. 5 is a side view of a spring of the rocker-frame assembly of FIG. 2A.
Figure 6A:
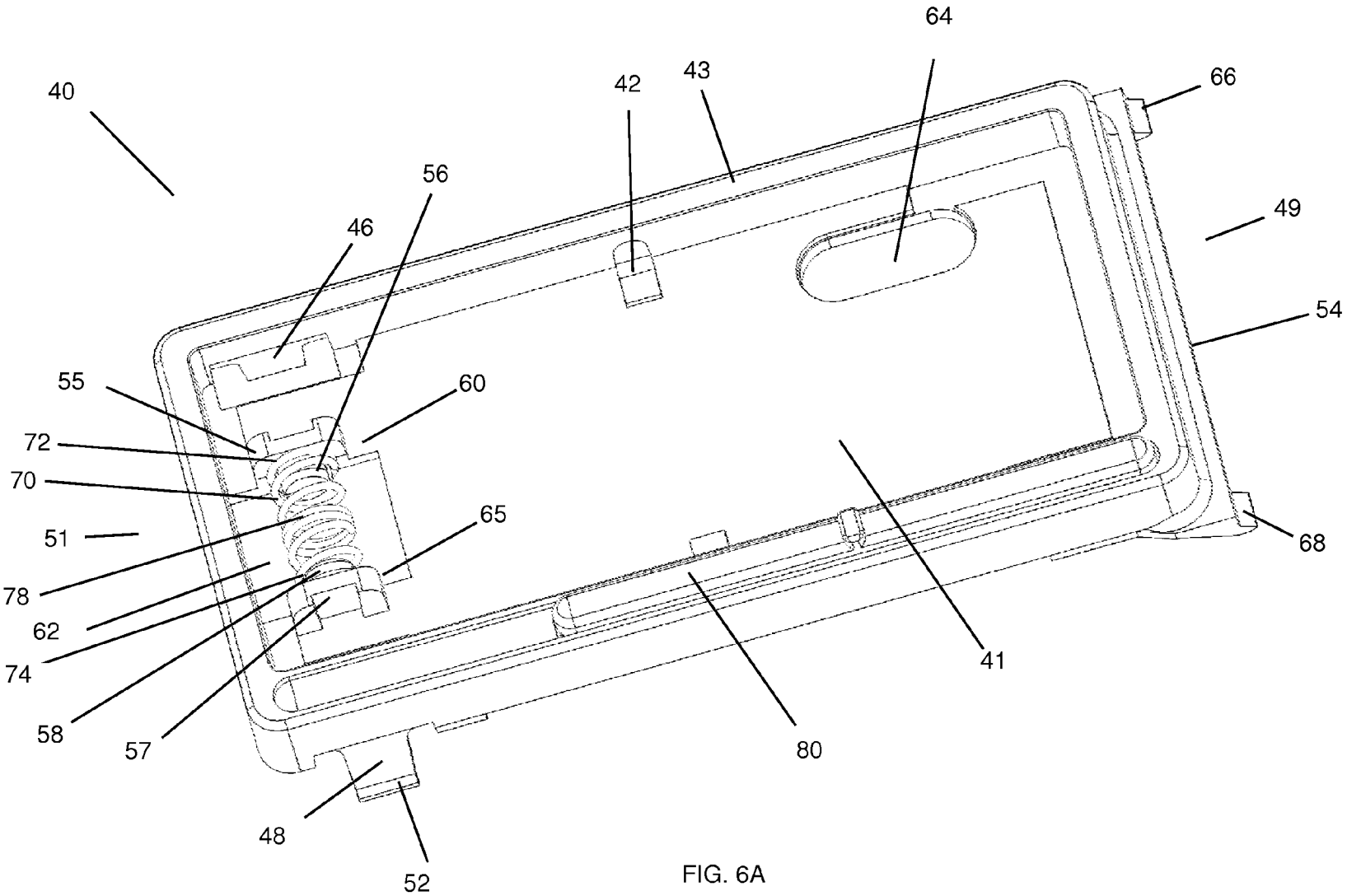
FIG. 6A is a perspective view of the slide switch, a frame and a spring of the rocker-frame assembly of FIG. 2A.
Figure 6B:
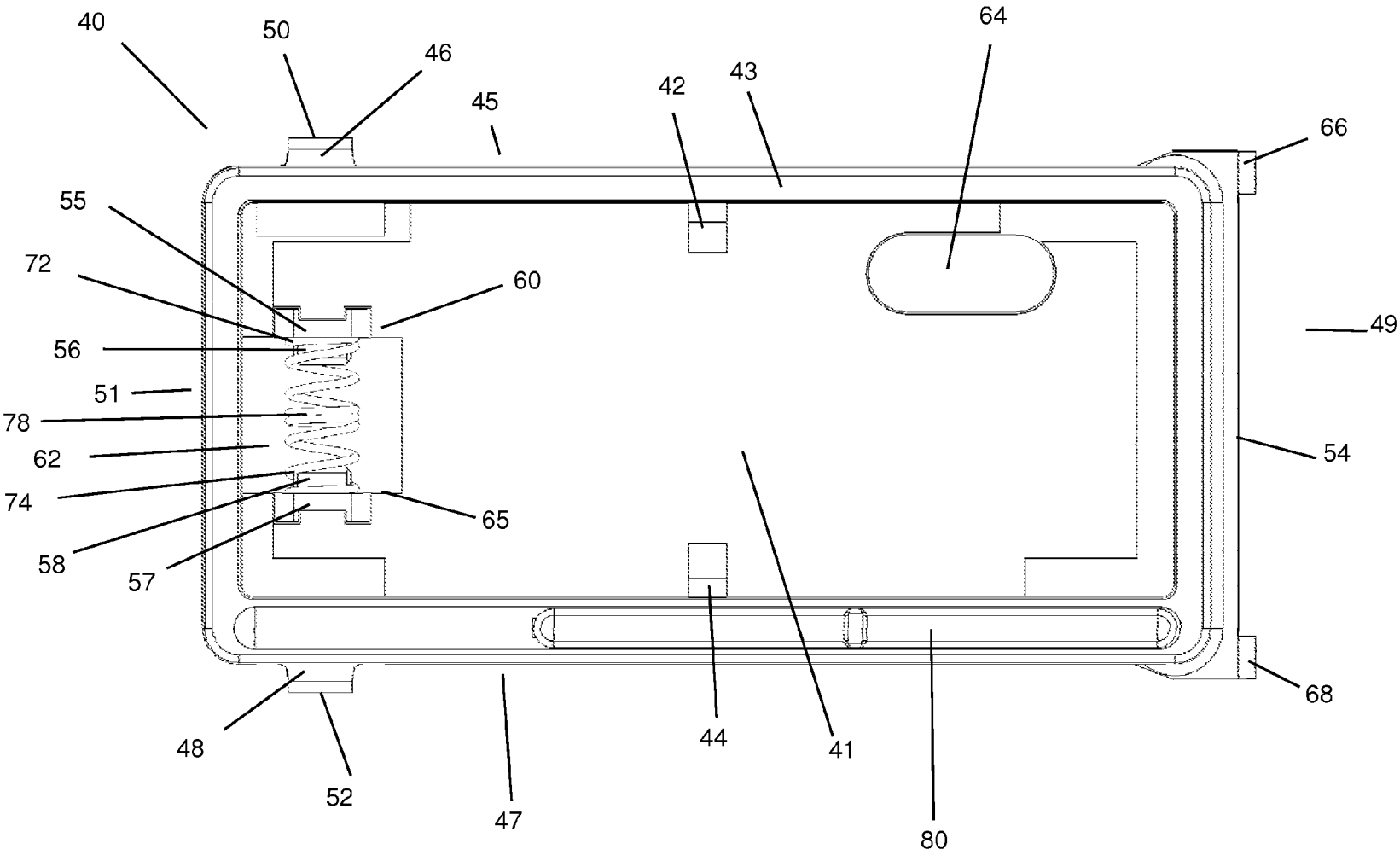
FIG. 6B is a top view of the slide switch, the frame and the spring of FIG. 6A.

As shown in FIGS. 5 and 6A-B, the spring 70 may include a first end 72, a second end 74, and a middle portion 76. The spring 70 may have a longitudinal axis Y' defined between the first and second ends 72, 74. The first end 72 of the spring 70 may be adapted and configured to be positioned around the first trunnion 56, and the second end 74 of the spring 70 may be adapted and configured to be positioned around the second trunnion 58. When the spring 70 is engaged with the first and second trunnions 56, 58, the first and second ends 72, 74 of the spring 70 are fixed against translation along an axis that is perpendicular to the longitudinal axis Y' of the spring 70, and positioned horizontally in the frame 40 so that it is substantially parallel to the pivot axis 19. In a preferred embodiment, the middle portion 76 may include a bearing surface 78, in which at least a portion of the spring coils are in a close or contacting relationship. Preferably, at least two adjacent, successive coils are in a close or contacting relationship. As will be described in more detail below, the bearing surface 78 is adapted and configured to engage the tab 18 of the rocker 10. The spring 70 may be any spring now or hereafter known in the art including a coil spring, a compression spring, and the like.

To assemble the rocker-frame assembly 5, the first and second ends 72, 74 of the spring 70 are coupled to the first and second trunnions 56, 58, respectively. Furthermore, the first and second pins 12, 14 of the rocker are received by the first and second slots 42, 44 of the frame 40, respectively, thereby enabling the rocker 10 to pivot within the frame 40 about the pivot axis 19. In other embodiments, the rocker may include first and second rocker mounting members that extend from the first and second sides of the rocker, respectively; and, the frame may include first and second frame mounting members that extend from the bottom wall and/or the peripheral wall. The first and second rocker mounting members may be arranged and configured to pivotally mount to the first and second frame mounting members respectively. The first and second rocker mounting members may include first and second pins respectively, the first and second pins defining a pivot axis. In addition, the first and second frame mounting members may include first and second slots respectively, the first and second slots arranged and configured to receive the first and second pins.

Figure 2D:
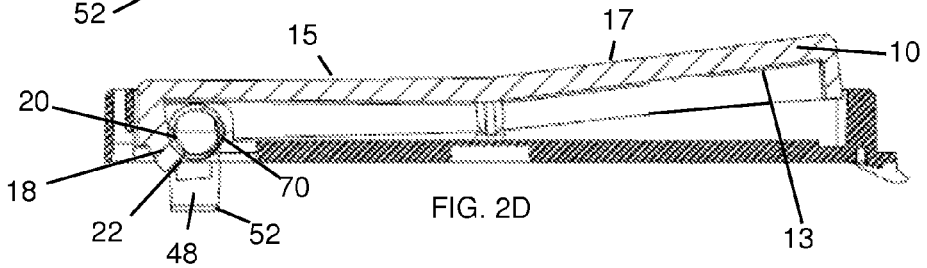
FIG. 2D is a sectional view of the rocker-frame assembly of FIG. 2C in a first position taken along section line A-A.
Figure 2E:
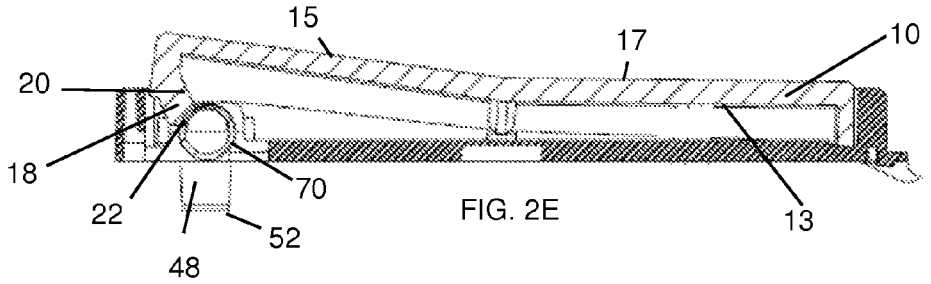
FIG. 2E is a sectional view of the rocker-frame assembly of FIG. 2C in a second position taken along section line A-A.
Figure 2F:
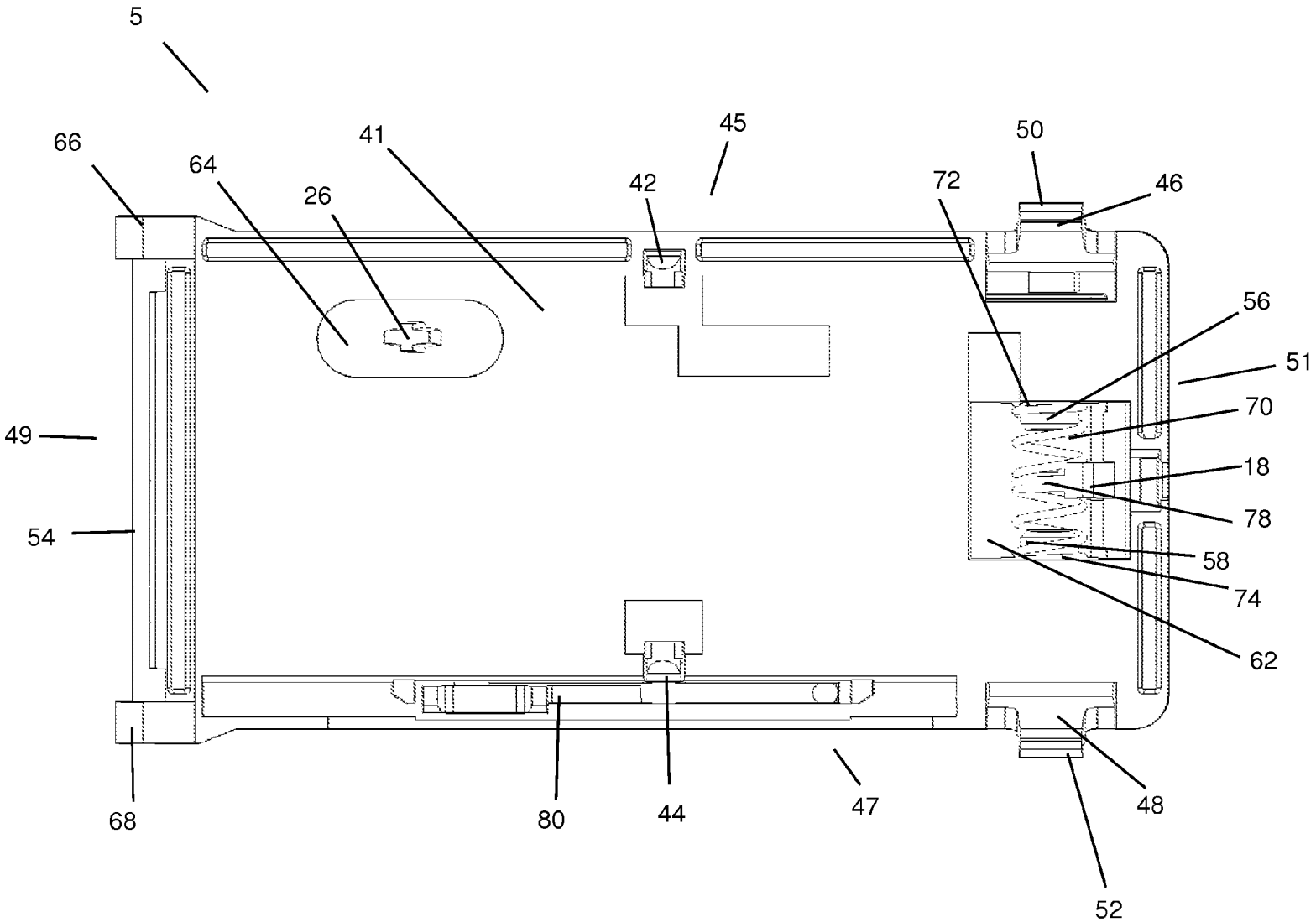
FIG. 2F is a bottom view of the rocker-frame assembly and the slide switch of FIG. 2A.

In use, the rocker 10 may pivotally rotate about the pivot axis 19 through a range of travel, for example, from a first position (see FIG. 2D) to a second position (see FIG. 2E). When the rocker 10 is in the first position, the switch 99 (see FIG. 7) is "off." More specifically, in the first position or "off", the arm 26 of the rocker 10 is in registered alignment with the switch 99 and the opening 64 of the frame 40, but the arm 26 is not pressing down on the switch 99. When the rocker 10 is in the second position, the switch 99 is "on." More specifically, in the second position or "on", the arm 26 of the rocker 10 is in registered alignment with the switch 99 and the opening 64 of the frame 40, and the arm 26 is pressing down on the switch 99 to thereby actuate the switch 99.

As shown in FIGS. 2D-E, when the rocker 10 is rotated about the pivot axis 19, the contact surface 21 of the tab 18 rides against the bearing surface 78 of the spring 70. More specifically, when the rocker 10 is in the first position (i.e. a user presses the first end 15 of the rocker 10), the first surface 20 of the tab 18 is in contact with the bearing surface 78 of the spring 70; and, the tab 18 displaces the spring 70 forward towards the direction of the pivot axis 19 and upward towards the direction of the bottom surface 13 of the rocker 10. Thus, the spring 70 is deflected perpendicular to its longitudinal axis Y' towards the direction of the pivot axis 19 when the rocker 10 is in the first position. When the rocker 10 is in the second position (i.e. a user presses the second end 17 of the rocker 10), the second surface 22 of the tab 18 is in contact with the bearing surface 78 of the spring 70; and, the tab 18 displaces the spring 70 forward towards the direction of the pivot axis 19 and downward towards the direction of the opening 62 of the frame 40. Thus, the spring 70 is deflected perpendicular to its longitudinal axis Y' downward towards the direction of the opening 62 when the rocker 10 is in the second position.

In both the first and second positions, the tab 18 applies force on the spring 70, displacing or bending the spring 70 so that the spring 70 follows the path of an arc; and, the buckling resistance of the spring 70 imparts a force on the rocker 10. That is, the spring 70 provides a biasing force to keep the rocker 10 in the first or second position until a user applies pressure to an end 15, 17 of the rocker 10, causing the rocker 10 to pivot about the pivot axis 19 to the other respective first or second position.

Figure 3A:
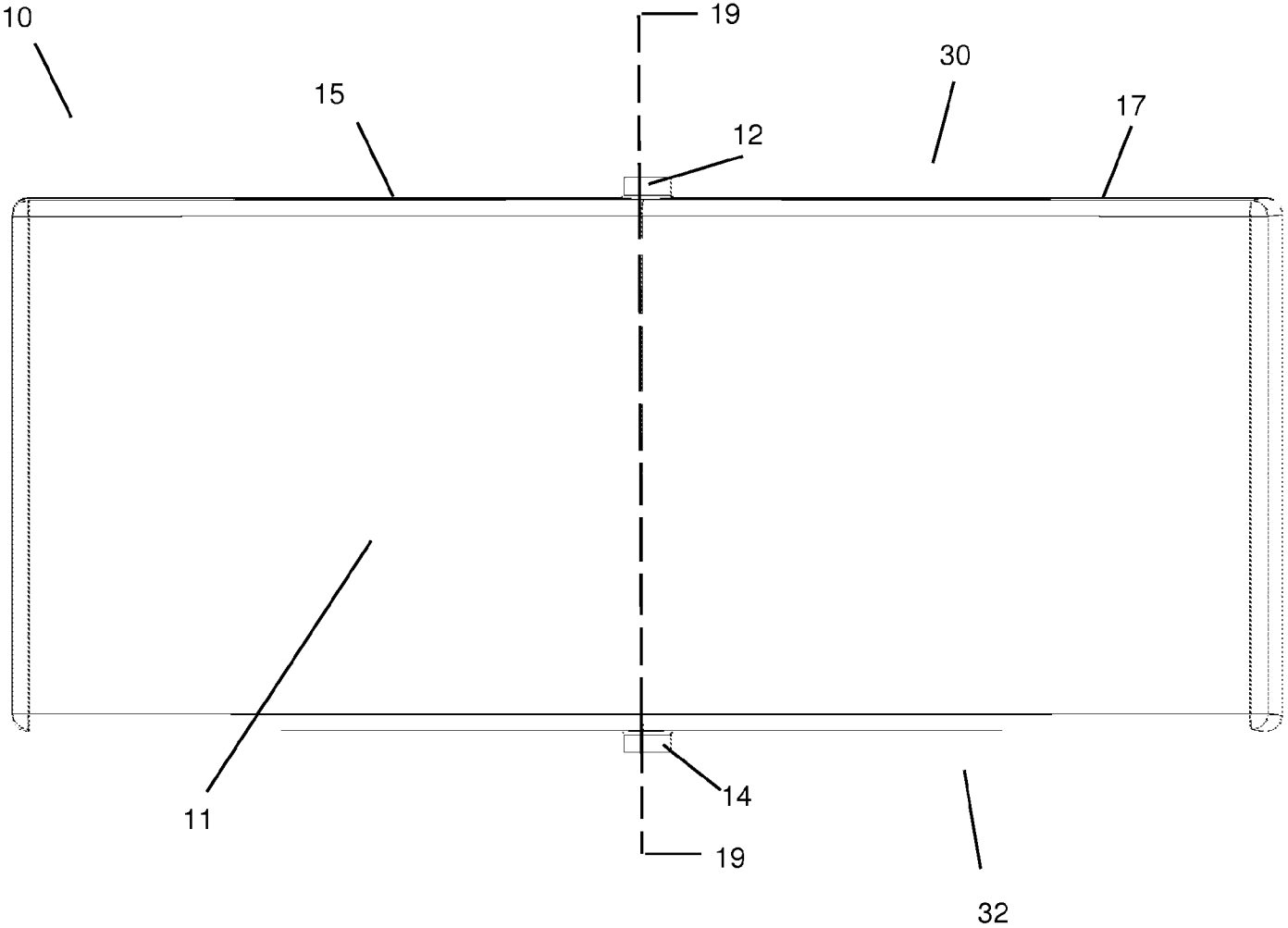
FIG. 3A is a front view of a rocker of the rocker-frame assembly of FIG. 2A.
Figure 3B:
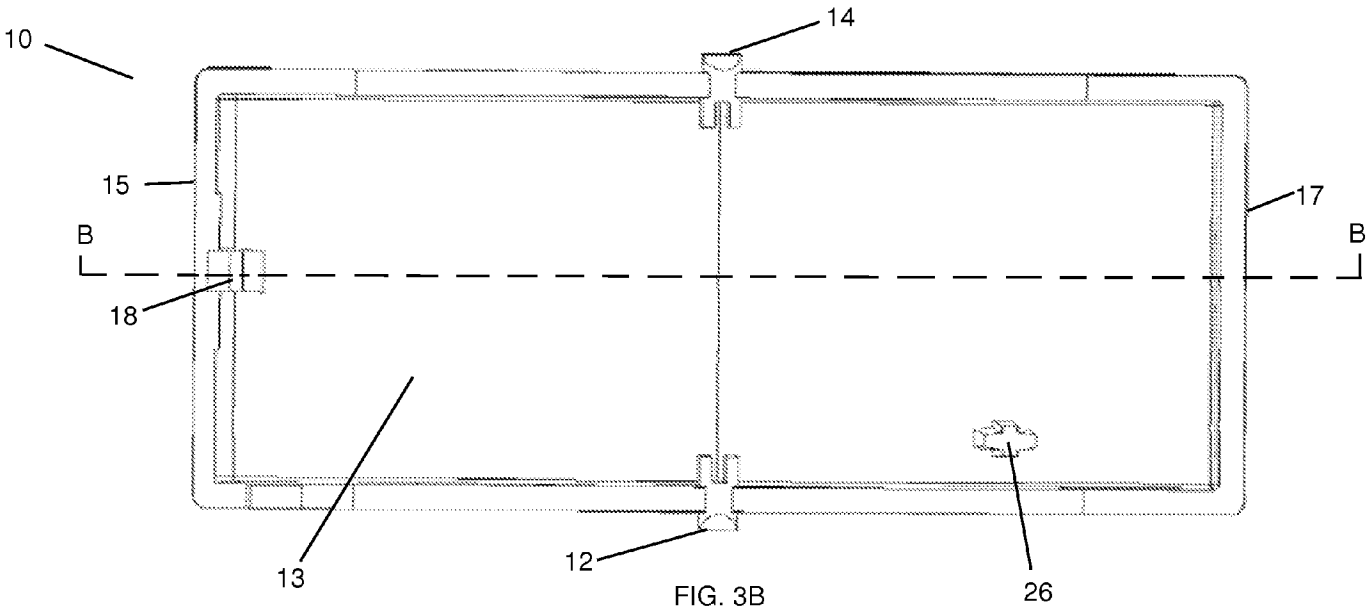
FIG. 3B is a bottom view of the rocker of FIG. 3A.
Figure 3C:
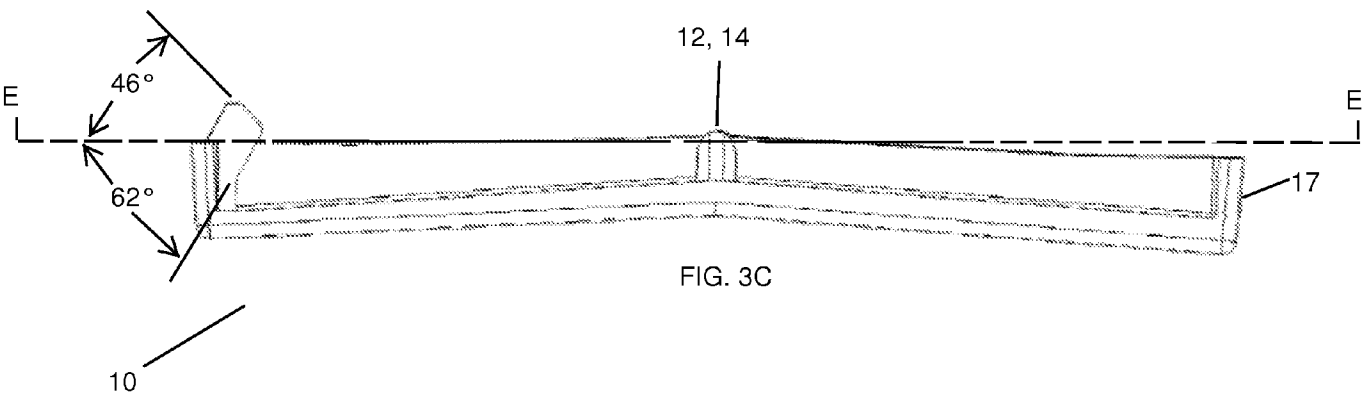
FIG. 3C is a sectional view of the rocker of FIG. 3B taken along section line B-B.

As shown in FIGS. 3A-C, the angle of the first surface 20 of the tab 18 is preferably 62 degrees relative to planar surface E-E, and the angle of the second surface 22 of the tab 18 is preferably 46 degrees relative to planar surface E-E. These examples of quantified angles of the first and second surfaces 20, 22 provide a balance so that the rocker 10 may be switched from the first position to the second position (and vice versa), with the user applying the same amount of force for each position. However, it will be understood by one of ordinary skill in the art that these quantified angles above are merely examples, and the first surface 20 and/or the second surface 22 may be of a different angle with respect to the planar surface E-E, as long as the angles are not perpendicular to the plane E-E. It will also be understood by one of ordinary skill in the art that the angles of the first and second surfaces may be dependent on the geometry of the tab.

In the exemplary embodiment described above, the tab 18 extends from the rocker 10, and the frame 40 is adapted and configured to engage with the spring 70 via the first and second support members 55, 57 and the first and second trunnions 56, 58. However, it will be understood by one of ordinary skill in the art that in other embodiments, the tab may extend from the frame; and, the first and second resilient member supports, and/or any other attachment feature or component that is adapted and configured to receive an end of the spring, may extend from the rocker. For example, the first and second resilient member supports may extend from the bottom surface of the rocker, the first and second sides of the rocker, etc.

The frame 40 may be attached to the electrical wiring device 90 in any convenient manner. As previously mentioned, in the exemplary embodiment shown in FIGS. 2A-F, 4A-B, 6A-B, and 7, the hinge 54 may be aligned with an opening 92 formed in the front housing 105, and the feet 66, 68 of the hinge 54 may be positioned within respective openings 96, 98 formed in the front housing 105 (see FIG. 7). The rocker-frame assembly 5 may be pivoted to the installed position. The first and second snaps 46, 48 of the frame 40 may pass through openings 91, 93 of the front housing 105 so that the latch portions 50, 52 snap into the respective openings 91, 93.

In the exemplary embodiment described above, the spring 70 is positioned horizontally between the rocker 10 and the frame 40, wherein the first and second ends 72, 74 of the spring 70 are held in place by the first and second trunnions 56, 58 respectively so that the spring 70 may not be displaced along its longitudinal axis Y', and the first and second ends 72, 74 are prevented from translating toward or away from the bottom surface 13 of the rocker 10. Thus, the overall depth of the rocker-frame assembly 5 may be minimized because extra space is not needed for the spring 70 to be displaced along its longitudinal axis and/or for the first and second ends 72, 74 of the spring 70 to translate. A decrease in overall depth of the rocker-frame assembly 5 may be ideal for applications, such as but not limited to, interchangeable color change kits that enable an installer or end user to easily change the color of the visible portions of the device to coordinate with changes in the building decor or occupant preferences.

In addition, in the exemplary embodiment described above, a slide potentiometer or slide switch 80 is positioned in the frame 40 adjacent the rocker 10. However, it will be understood by one of ordinary skill in the art that in other embodiments, the electrical wiring device may not include a slide potentiometer or slide switch, or may include a slide potentiometer or slide switch but of a different shape, size, etc. Furthermore, in other embodiments, the slide potentiometer or slide switch may be in a different position or configuration on the device, such as but not limited to, being positioned within the rocker. Furthermore, in other embodiments, the incorporation of a horizontally aligned spring according to the description herein may be employed in switching of a dimmer or any other electrical wiring device.

A method for assembling an electrical device 90 will now be described. The spring 70 is positioned on the frame 40 as described in detail above. The first end 72 of the spring 70 may pass over the first trunnion 56 of the frame 40, and the second end 74 of the spring 70 may pass over the second trunnion 58 of the frame 40. The rocker 10 may be pivotally attached or mounted to the frame 40 to enable the tab 18 on the rocker 10 to deflect the spring 70 perpendicular to a longitudinal axis of the spring 70 when the rocker 10 is in a first position and a second position. The first and second slots 42, 44 on the frame 40 are adapted and configured to receive the first and second pins 12, 14 on the rocker 10.

To attach the rocker-frame assembly 5 to the front housing 105, the user aligns a hinge 54 on the frame 40 with the opening 92 on the front housing 105, and inserts the first and second feet 66, 68 and the hinge 54 on the frame 40 into the openings 92, 96, 98 on the front housing 105, respectively. The user may then pivot the rocker-frame assembly 5 into the installed position by inserting the first and second snaps 46, 48 of the frame 40 into the openings 91, 93 on the front housing 105 that are adapted and configured to be aligned with the snaps 46, 48 until the latches 50, 52 on the snaps 46, 48 engage the openings 91, 93 to hold the rocker-frame assembly 5 in the installed position.

Referring to FIG. 8A-B, in another exemplary embodiment, the resilient member of the electrical wiring device may be a wire 270. The wire 270 may include a first end 272, a second end 274, and a middle portion 276. The first end 272 is adapted and configured to be positioned between a bottom wall 241 of the frame 240 and a first support member 255 that extends from the bottom wall 241. The second end 274 of the wire 270 is adapted and configured to be positioned between the bottom wall 241 of the frame 240 and a second support member 257 that extends from the bottom wall 241. The wire 270 is positioned in the frame 240 so that the wire 270 is stationary, and the middle portion 276 is substantially parallel to the pivot axis 219.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A switch actuator assembly for activating a switch in an electrical wiring device comprising:

a. a frame including a peripheral wall;

b. a rocker pivotally mounted to the frame and configured to rotate between a first position and a second position;

c. first and second resilient member supports extending from opposite sides of one of the frame or the rocker, the first and second resilient member supports arranged and configured to be in registered alignment with respect to one another to form an axis;

d. a tab including a contact surface, the tab extending from the other of the frame or the rocker;

e. a resilient member including a first end, a second end, and a middle portion, the resilient member having a longitudinal axis defined between the first and second ends, the first and second ends being configured to engage the first and second resilient member supports, respectively, and the middle portion being configured to interact with the tab, wherein the contact surface of the tab deflects the resilient member in a direction that is perpendicular to the longitudinal axis of the resilient member when the rocker is in the first position and the second position.

2. The switch actuator assembly of claim 1, wherein the rocker includes first and second pins defining a pivot axis, and the frame includes first and second slots to receive the first and second pins.

3. The switch actuator assembly of claim 1, wherein the resilient member is a coil spring.

4. The switch actuator assembly of claim 1, wherein the resilient member is a wire.

5. The switch actuator assembly of claim 3, wherein the middle portion includes a bearing surface having a plurality of coils in a contacting relationship.

6. The switch actuator assembly of claim 1, wherein the first and second ends of the resilient member are fixed against translation along an axis that is perpendicular to the longitudinal axis of the resilient member.

7. The switch actuator assembly of claim 1, wherein the rocker includes a top surface and a bottom surface, the tab extending from the bottom surface of the rocker, and wherein the frame includes a bottom wall arranged between the peripheral wall, the bottom wall including a first opening formed therein and that is arranged and configured to be in registered alignment with the tab of the rocker to allow the tab to extend at least partially through the first opening when the rocker is in the first position.

8. The switch actuator assembly of claim 7, wherein the first and second resilient member supports include first and second support members, respectively, the first and second support members extending from the bottom wall of the frame and positioned on opposite sides of the first opening formed in the bottom wall.

9. The switch actuator assembly of claim 8, wherein the first and second resilient member supports further include first and second trunnions extending from the first and second support members, respectively.

10. The switch actuator assembly of claim 1, wherein the frame, the rocker, and the resilient member comprise an interchangeable kit.

11. The switch actuator assembly of claim 1, wherein the contact surface includes a first surface and a second surface, the first surface being arranged and configured to deflect the resilient member when the rocker is in the first position and the second surface being arranged and configured to deflect the resilient member when the rocker is in the second position.

12. The switch actuator assembly of claim 1, wherein the first surface and the second surface of the tab are angled relative to a planar surface that is substantially parallel to the longitudinal axis of the resilient member.

13. The switch actuator assembly of claim 7, wherein the rocker further includes a first end, a second end, and an arm, the tab extending from the bottom surface of the first end of the rocker, and the arm extending from the bottom surface of the second end of the rocker.

14. The switch actuator assembly of claim 13, wherein the arm is arranged and configured to actuate the switch in the electrical wiring device when the rocker is in the second position.

15. The switch actuator assembly of claim 1, wherein the frame includes first and second snaps and first and second feet configured to be removably attached to the electrical wiring device.

16. A switch actuator assembly for activating a switch in an electrical wiring device comprising:

a. a frame including first and second frame mounting members, a bottom wall, and first and second trunnions, the first and second frame mounting members extending from the bottom wall, and the first and second trunnions parallel to the bottom wall and projecting inwardly;

b. a rocker including a bottom surface, a tab extending from the bottom surface of the rocker and having first and second surfaces, and first and second sides having first and second rocker mounting members respectively, the first and second rocker mounting members arranged and configured to pivotally mount to the first and second frame mounting members respectively, wherein the rocker is adapted and configured to pivotally rotate between a first position and a second position:

c. a resilient member including first and second ends and a bearing surface, the resilient member having a longitudinal axis defined between the first and second ends, the first and second ends being configured to engage the first and second trunnions respectively, and the bearing surface being arranged and configured to interact with the tab of the rocker, wherein the first surface of the tab deflects the bearing surface of the resilient member when the rocker is in the first position, and the second surface of the tab deflects the bearing surface of the resilient member when the rocker is in the second position.

17. The switch actuator assembly of claim 16, wherein the resilient member is a coil spring.

18. The switch actuator assembly of claim 17, wherein at least a portion of the bearing surface includes a plurality of coils in a contacting relationship.

19. The switch actuator assembly of claim 16, wherein the first and second rocker mounting members include first and second pins respectively, the first and second pins defining a pivot axis, and wherein the first and second frame mounting members include first and second slots respectively, the first and second slots arranged and configured to receive the first and second pins.

20. The switch actuator assembly of claim 16, wherein the first and second ends of the resilient member are fixed against translation along an axis that is perpendicular to the longitudinal axis of the resilient member.

21. The switch actuator assembly of claim 16, wherein the bottom wall of the frame includes a first opening formed therein, the first opening arranged and configured to be in registered alignment with the tab of the rocker to allow the tab to extend at least partially through the first opening when the rocker is in the first position, and wherein the first and second trunnions are positioned on opposite sides of the first opening.

22. The switch actuator assembly of claim 21, wherein the frame further includes first and second support members extending from the bottom wall of the frame and positioned on opposite sides of the first opening, the first and second trunnions extending from the first and second support members respectively.

23. The switch actuator assembly of claim 16, wherein the frame, the rocker, and the resilient member comprise an interchangeable kit.

24. The switch actuator assembly of claim 16, wherein the first and second surfaces of the tab are angled relative to a planar surface that is substantially parallel to the longitudinal axis of the resilient member.

25. The switch actuator assembly of claim 16, wherein the rocker further includes a first end, a second end, and an arm, the tab extending from the bottom surface of the first end of the rocker, and the arm extending from the bottom surface of the second end of the rocker.

26. The switch actuator assembly of claim 25, wherein the arm is arranged and configured to actuate the switch in the electrical wiring device when the rocker is in the second position.

27. The switch actuator assembly of claim 16, wherein the frame includes first and second snaps and first and second feet configured to be removably attached to the electrical wiring device.

* * * * *